United States Patent [19]

Reida

[11] 4,113,311

[45] Sep. 12, 1978

[54] SINGLE PIVOT CONNECTION FOR A LEGREST

[75] Inventor: William D. Reida, Divide, Colo.

[73] Assignee: AMI Industries, Inc., Colorado Springs, Colo.

[21] Appl. No.: 818,805

[22] Filed: Jul. 25, 1977

[51] Int. Cl.[2] ..... A47C 7/50

[52] U.S. Cl. ..... 297/433

[58] Field of Search ..... 297/433–436

[56] References Cited

U.S. PATENT DOCUMENTS

| | | | |
|---|---|---|---|
| 2,217,352 | 10/1940 | Todd et al. | 297/433 |
| 2,257,150 | 9/1941 | Beeson | 297/433 |
| 2,284,129 | 5/1942 | Caesar | 297/433 |
| 3,087,757 | 4/1963 | Fidel | 297/434 |

*Primary Examiner*—James C. Mitchell

*Attorney, Agent, or Firm*—W. Britton Moore

[57] ABSTRACT

A single pivot connection for a legrest of a vehicle seat and the like includes a shaft extending from a bracket attached to the seat and an arm bracket attached to the legrest and pivotally supported upon the shaft. The arm bracket has a cylindrical portion and there is a hub on the end of the cylindrical portion with a circumferentially extending notch therein which receives a key formed in an annular member rotatably positioned upon the hub. A gear mounted on the shaft is engageable with a pawl and there is a braking disc between the end of the cylindrical portion and gear such that the application of a predetermined force on the legrest will pivot the legrest with respect to the seat. The pawl engages the gear as the legrest pivots to a horizontal position and pivoting beyond the horizontal to the vertical up position causes cam surfaces on the annular member to disengage the pawl from the gear so that the legrest is free for pivotal movement.

5 Claims, 6 Drawing Figures

SINGLE PIVOT CONNECTION FOR A LEGREST

The present invention relates to dual or multiple seats such as employed in railway cars, passenger buses and aircraft, more particularly, to a pivot connection for attaching legrests to such seats.

In order to enhance the attractiveness of travel by rail or by air, railway passenger cars and aircraft have been provided with comfortable seats. Such seats generally comprise an individual seat portion to which is attached a tiltable back and armrests. Generally, however, such seats are not provided with feet or legrests and the passenger must rest his feet upon a bar or some other structure usually provided on the seats in front of him. In order to make such seats more comfortable, various forms of legrests have been proposed. In general, such legrests are attached to the seat structure and are movable to various angular positions with respect to the seat to enable the passenger to rest his legs in a comfortable position.

Such legrests have been unsatisfactory since they could be positioned only in a relatively limited range of settings or positions. Thus, passengers of a height above or below average height frequently found it difficult to comfortably position their legs.

A further disadvantage to these prior art devices is that the structure for pivoting the legrest to various positions was unduly complicated and occasionally presented difficulties in operation to the passengers. In addition, when such a legrest was elevated to a substantially horizontal position it prevented free movement of a passenger in front thereof in reaching another seat or the aisle of the vehicle.

It is, therefore, the principal object of the present invention to provide a novel and improved pivot connection between a legrest and a seat for an aircraft or railway vehicle.

It is another object to provide such a pivot connection which enables the legrest to be readily adjustable for maximum passenger comfort.

It is an additional object of the present invention to provide a pivot connection which will enable the legrest to be moved through a wide range of positions and settings beyond the usual comfort positions sought by occupants of the seat.

It is an additional object of the present invention to provide such a pivot connection which will enable the legrest to be depressed upon application of a predetermined force thereto without injury to the user or damage to any of the components of the connection.

According to one aspect of the invention, a pivot connection for a legrest of an aircraft seat and the like may comprise a mounting bracket secured to the armrest of a seat and having a shaft extending therefrom. An arm bracket is attached to a legrest and has a cylindrical portion with a hub formed on the end surface of the cylindrical portion. The hub has a circumferentially extending notch therein and is pivotally mounted on the shaft. A gear having peripheral gear teeth is non-rotatably mounted on a sleeve on the shaft and a pawl is engageably with the gear teeth. The hub is provided with means having limited pivotal movement thereon for disengaging the pawl from the gear teeth when the legrest is pivoted through a predetermined angle with respect to the seat. A braking disc is positioned between the end of the cylindrical portion and the gear and means is provided for resiliently urging the hub, gear and braking disc together with a predetermined force so that the legrest is pivotable downwardly upon application of a predetermined force thereto.

Other objects and advantages will be apparent when the specification is considered with the accompanying drawings, wherein.

Proceeding next to the drawings wherein like reference symbols indicate the same parts throughout the various views, a specific embodiment and modifications of the present invention will be described in detail.

Figure 1:
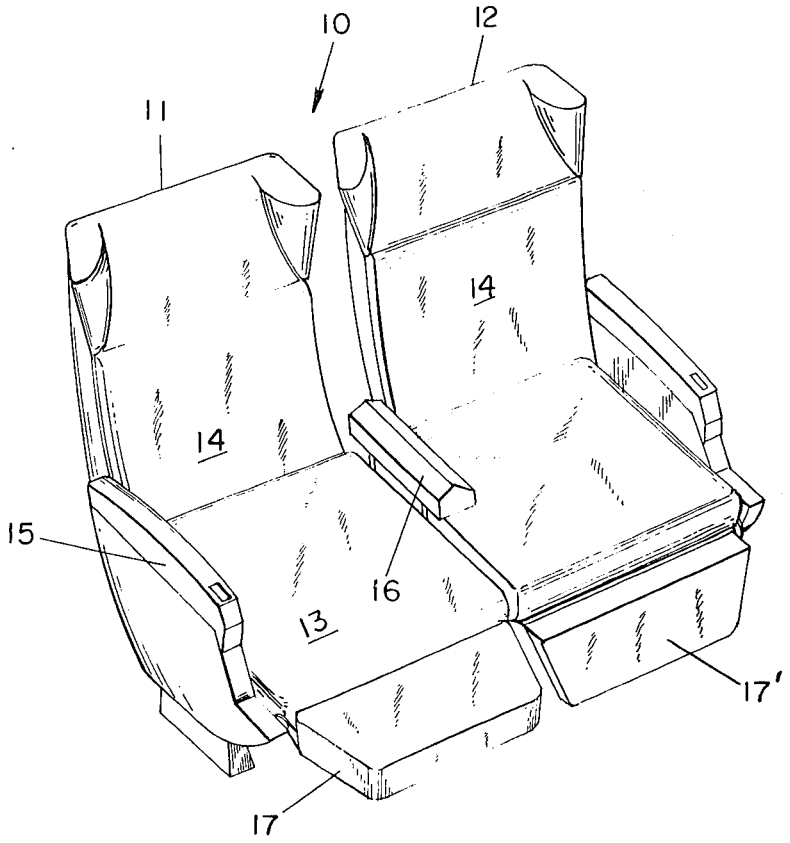
FIG. 1 is a perspective view of a pair of seats provided with the legrests and pivot connections of the present invention.
Figure 2:
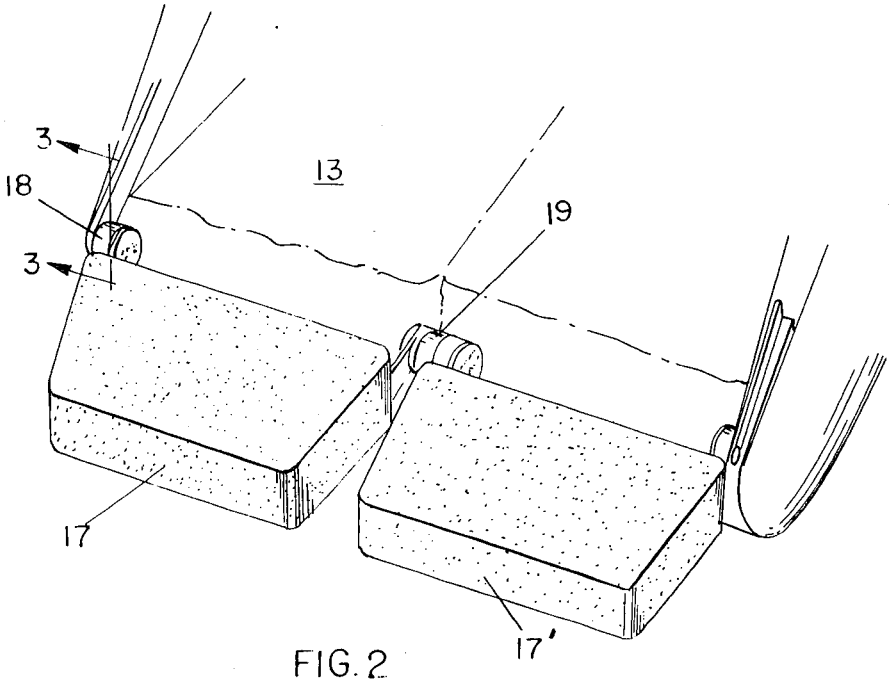
FIG. 2 is a view in perspective of the front portions of the seats in somewhat enlarged scale and showing the legrests in substantially horizontal elevated positions.

In FIG. 1 there is indicated generally at 10 a dual or multiple seat of the type employed in aircraft and railway vehicles and comprising seats 11 and 12 each of which has a seat portion or cushion 13, a back 14, an armrest 15 and a center armrest 16. A legrest 17 is pivotally connected to the forward edge of the seat portion 13 by an end pivot connection 18 and a center pivot connection 19.

Figure 6:
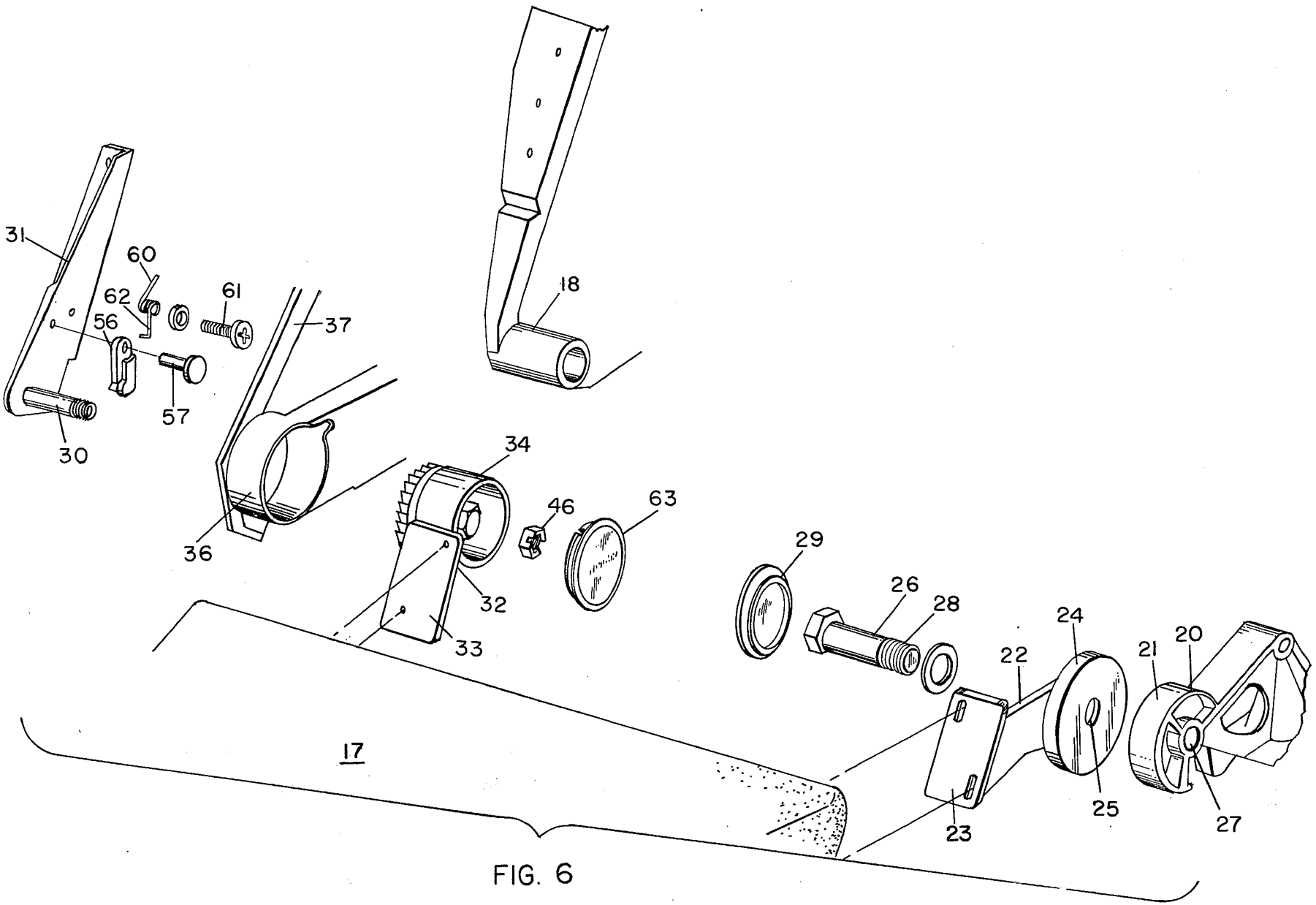
FIG. 6 is an exploded view in perspective of the components of the pivot connection seen in FIG. 3.

Center pivot connection 19 is shown in greater detail in FIG. 6 and includes a center bracket 20 having a hub portion 21 which is supported in a circular mount attached to the frame of the seat and not shown in the drawings. An arm bracket 22 has a base 23 which is attached to the rear edge of legrest 17 and is provided with a circular portion 24 having an opening 25 therethrough to receive a bolt 26 which passes through an aligned opening 27 in bracket 20 to be connected to a similar bracket 22 attached to legrest 17'. Bolt 26 has a threaded end 28 upon which is positioned a nut, not shown, to secure the connection. A cap 29 is then positioned over the open portion of hub 24 to enclose the head of the bolt.

Figure 3:
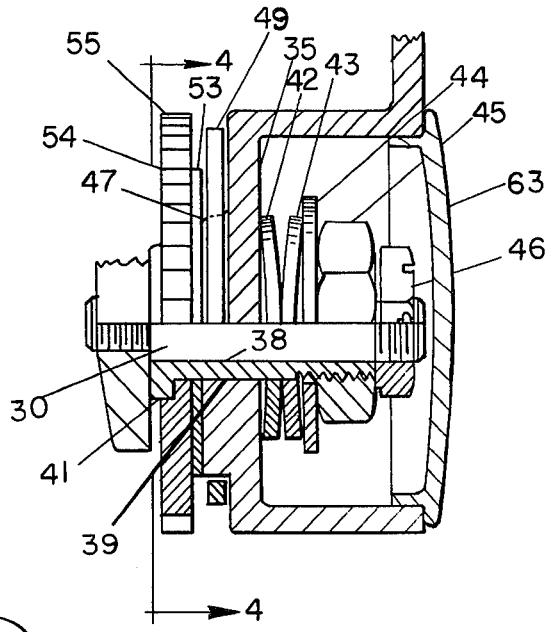
FIG. 3 is a sectional view taken along the line 3—3 of FIG. 2.

The end pivot connection 18 permits of a wide range of adjustability of the legrest and includes a shaft 30 attached to the end of a mounting bracket 31 secured to the frame of the armrest. An arm bracket 32 has a base portion 33 attached to the edge of the legrest 17 and is provided with a cylindrical portion 34 having an end surface 35 as seen in FIG. 3. The cylindrical portion 34 is pivotally received within a cylindrical shell 36 formed on the inner shell 37 of the armrest.

End surface 35 of the arm bracket cylindrical portion 34 is formed with an opening 38 which receives both the shaft 30 and a sleeve 39 rotatably positioned over the shaft and formed with a plurality of notches 40 in its head 41. Also mounted on the sleeve 39 are concave compression washers 42 and 43 positioned as shown in FIG. 3 and, together with a washer 44, urged against the inner surface of the end portion 35 by a nut 45 threaded on the end of the sleeve 39. The sleeve 39 is retained on the shaft 30 by a nut 46 and, if desired, by a cotter pin.

On the outer surface of the end surface 35 is formed a hub 47 having a circumferentially extending notch 48 therein. Pivotally positioned upon the hub is a pawl release 49 in the form of an annular member and provided with a radially extending key 50 received within the notch 48. The peripheral surface of the pawl release member is formed with a raised cam surface 51 and a projecting cam surface 52.

Figure 4:
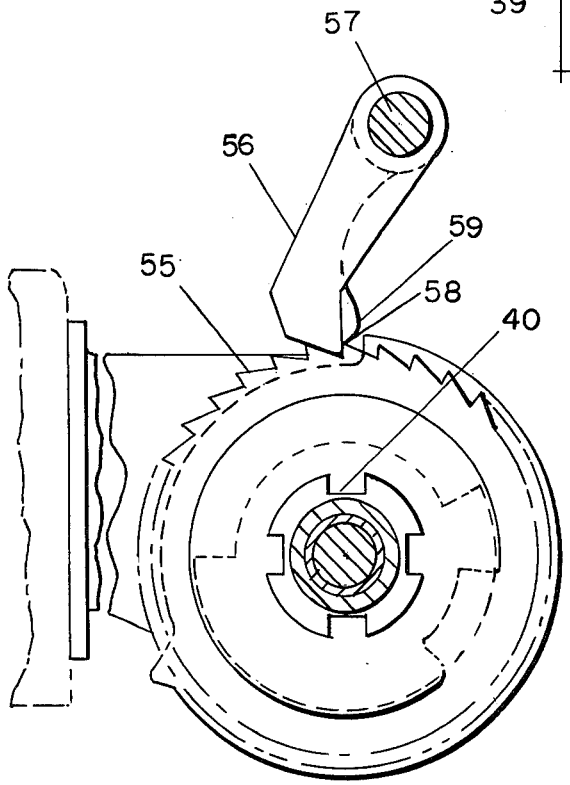
FIG. 4 is an elevational view taken in the direction of the line 4—4 of FIG. 3 and showing the pawl engaging the gear teeth.
Figure 5:
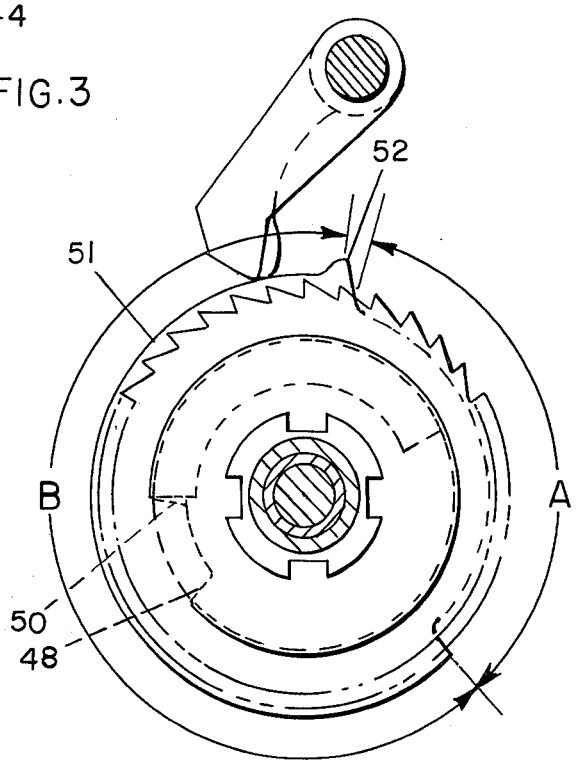
FIG. 5 is a view similar to that of FIG. 4, but showing the pawl disengaged from the gear teeth to allow free pivoting movement of the legrest.

A brake disc 53 of suitable braking material is positioned adjacent the hub 47 upon the sleeve 39, and adjacent the brake disc 53 is a gear 54 having peripheral gear teeth 55, as shown in greater detail in FIGS. 4 and 5. A pawl member 56 is pivotally mounted by a pin 57 to the mounting bracket 31 and the pawl includes a pointed edge 58 engageable with the gear teeth 55 and a cam member 59 engageable with the cam surface on the annular member 49. A spring 60 mounted by a screw 61 to the bracket 31 has an end 62 which urges the pawl member 56 into engagement with the gear teeth 55 and the annular pawl release member 49. The open end of the cylindrical portion 34 on the arm bracket 32 is enclosed by an end cap 63 as best shown in FIG. 3.

The sleeve 39 is rotatable through an angle of 360° around the shaft 30, but its movement on the shaft is inhibited by the brake disc 53. Braking friction is produced by the brake disc between the opposing surfaces of the arm bracket hub 47 and the gear 54 by the force exerted by the compression washers 42 and 43 and the force exerted by these compression washers can be adjusted, as may be desired, by the nut 45.

Annular pawl release element 49 is free to pivot within a limited range, as defined by the key 50 moving within the recess 48. When the legrest 17, attached to the bracket arm 32, is moved from its horizontal position through a range A, as shown in FIG. 5, the pawl 56 will engage the gear teeth 55. The pawl 56 will ratchet upon the gear teeth, as the legrest 17 is pivoted upwardly from substantially a horizontal position. Should any downward force be exerted against the legrest 17, when it is in an adjusted position, any force, exceeding the predetermined pressures upon the brake disc 53, will cause the bracket arm 32 to pivot counterclockwise through the range A while the pawl 56 is engaged with the gear teeth 55.

Should the legrest 17 be pivoted upwardly past a horizontal position to the vertical up position and into the range B, the cam 52 on the annular member 49 will move the pawl-cam portion 58 upwardly so as to disengage the pawl from the gear teeth 55. The bracket arm 32 is now capable of free movement within the range B to the vertical down position.

It is, thus, apparent that the pivot legrest may be pivoted, from a stored or inactive position under and parallel to the seat 13, to a vertical down position, upwardly to a fully extended, substantially horizontal position on a plane with the upper surface of the bottom seat cushion, and thence up to an upstanding position which would permit swiveling of the seats and facilitate cleaning of the floors therebeneath. This placement also enables the legrest to be stowed above the bottom seat cushion to clear the lower seat structure during seat rotation in railroad seating. Stowage of the legrests under the seat frame provides maximum leg and foot clearance and comfort for passengers without any interference to the lower seat structure. The location of a single pivot for each legrest at one side only of each seat facilitates easy operation thereof by the legrest rotating from a single pivot point. Thus, the legrests are relatively fixed structures requiring no folding or locking of dependent legs or intermediate structures as it is solely supported by the single pivot.

The absence of any operating buttons, locks, or other operating levers enables a passenger who may be confused or unfamiliar with the operation sequence to manually kick or hit the legrest until it is pivoted downwardly and/or stowed again under the seat. The inclusion of the friction brake mechanism prohibits a legrest from remaining static under impact loads occuring from passengers falling or stumbling thereagainst and thereby eliminates a potential safety hazard. This mechanism also limits the amount of load transmitted to the seat structure by slipping the ratchet when a given load on a legrest is exceeded.

Furthermore, as the pivot mechanism is located at one side only of each seat, it will be evident that the legrests extend the full width of each seat cushion 13. Consequently, the upholstered or cushion structure of each legrest enables the frames thereof to be fully embedded in foam and materially reduces the possibility of passengers being injured should impact therewith being insufficient to cause slippage of the friction brake.

While a preferred embodiment of this novel and improved pivot connection for legrests has been shown and described, it is to be understood that various changes and improvements may be made therein without departing from the scope and spirit of the appended claims.

What is claimed is:

1. A single pivot connection for a legrest of a vehicle seat and the like comprising a mounting bracket secured to the inner sheel of an armrest of a seat and having a shaft extending therefrom, an arm bracket attached to a legrest and having a cylindrical portion with an end surface, there being a hub on the end surface of said cylindrical portion and having a circumferentially extending notch therein, said end surface being pivotally mounted on said shaft, a gear having peripheral gear teeth non-rotatably mounted on said shaft, a pawl member engageable with said gear teeth, means mounted on said hub and having limited pivotal movement thereon for disengaging said pawl member from said gear teeth when said legrest is pivoted through a predetermined angle with respect to said seat, a braking disc between the cylindrical portion of said hub and said gear, and means for resiliently urging said hub, gear and braking disc together at a predetermined force so that said legrest is pivotable downwardly upon application of a predetermined force thereto.

2. A single pivot connection as claimed in claim 1 wherein said disengaging means comprises an annular member having peripheral cam surfaces thereon rotatably positioned upon said hub and having a key received within said hub notch, said pawl member having a cam element thereon engageable with said annular member cam surfaces, said pawl member engaging said gear teeth during pivoting of said legrest through a predetermined angle and pivoting of said legrest beyond said predetermined angle causes a cam surface on said annular member to disengage said pawl from said teeth whereby said legrest is free for pivotal movement.

3. A single pivot connection as claimed in claim 1 wherein said urging means comprises a pair of concave compression washers on said shaft and a nut threaded on said shaft.

4. A single pivot connection as claimed in claim 1 wherein said pawl engages said gear teeth through an angle of about 90° as said legrest is pivoted upwardly from a horizontal position.

5. A single pivot connection as claimed in claim 1 wherein said pawl is disengaged from said gear teeth when the legrest is pivoted upwardly beyond the horizontal position to the vertical up position.

* * * * *